US009410286B2

(12) United States Patent
Bergdahl et al.

(10) Patent No.: US 9,410,286 B2
(45) Date of Patent: Aug. 9, 2016

(54) SCREENING APPARATUS, ROTOR, WING PACKAGE AND METHOD FOR MANUFACTURE

(71) Applicant: Valmet AB, Sundsvall (SE)

(72) Inventors: Anders Bergdahl, Sundsbruk (SE); David Lindkvist, Alnö (SE)

(73) Assignee: Valnet AB (SE)

( * ) Notice: Subject to any disclaimer, the term of this patent is extended or adjusted under 35 U.S.C. 154(b) by 0 days.

(21) Appl. No.: 14/647,654

(22) PCT Filed: Nov. 27, 2013

(86) PCT No.: PCT/SE2013/051402

§ 371 (c)(1),
(2) Date: May 27, 2015

(87) PCT Pub. No.: WO2014/084788

PCT Pub. Date: Jun. 5, 2014

(65) Prior Publication Data

US 2015/0345077 A1 Dec. 3, 2015

(30) Foreign Application Priority Data

Nov. 28, 2012 (SE) ..... 1251345

(51) Int. Cl.
*D21F 1/00* (2006.01)
*D21D 5/02* (2006.01)

(52) U.S. Cl.
CPC ..... *D21F 1/0027* (2013.01); *D21D 5/026* (2013.01); *Y10T 29/49828* (2015.01)

(58) Field of Classification Search
CPC ..... D21F 1/00; D21D 5/02
USPC ..... 162/263; 29/428
See application file for complete search history.

(56) References Cited

U.S. PATENT DOCUMENTS 2,752,828 A 7/1956 Sandison
2,975,899 A 3/1961 Cannon et al.

(Continued)

FOREIGN PATENT DOCUMENTS

EP 0205623 A1 12/1986
EP 0444051 A1 9/1991

(Continued)

OTHER PUBLICATIONS

International Search Report for Application No. PCT/SE2013/051402 dated Feb. 19, 2014.

*Primary Examiner* — Mark Halpern
(74) *Attorney, Agent, or Firm* — Lerner, David, Littenberg, Krumholz & Mentlik, LLP

(57) ABSTRACT

Screening apparatus for screening pulp suspensions are provided. The screening apparatus includes a casing, a cylindrical screen member is arranged on the casing for dividing the pulp into accept and reject portions, an inlet for the pulp, an outlet for the accept, an outlet for the reject, a rotor with a rotor body, and at least one pulsator located on the inside of the screen, so that a screening chamber is formed between the rotor and the screen. The rotor is provided with a detachable pulsator package including at least one attachment ring attached to the rotor body, at least one support ring attached to or supported by the rotor body and the at least one pulsator attached to the at least one attachment ring and the at least one support ring.

18 Claims, 5 Drawing Sheets

(56) References Cited

U.S. PATENT DOCUMENTS

| | | | |
|---|---|---|---|
| 3,034,650 | A | 5/1962 | Szepan |
| 3,387,708 | A | 6/1968 | Salomon et al. |
| 3,497,060 | A | 2/1970 | Tra et al. |
| 4,328,096 | A | 5/1982 | Chupka et al. |
| 4,374,728 | A | 2/1983 | Gauld |
| 4,744,894 | A | 5/1988 | Gauld |
| 2001/0011641 | A1 | 8/2001 | Fukudome et al. |

FOREIGN PATENT DOCUMENTS

| | | | |
|---|---|---|---|
| EP | 0868564 | A1 | 10/1998 |
| WO | 9005807 | A1 | 5/1990 |
| WO | 9713919 | A1 | 4/1997 |

SCREENING APPARATUS, ROTOR, WING PACKAGE AND METHOD FOR MANUFACTURE

CROSS-REFERENCE TO RELATED APPLICATIONS

The present application is a national phase entry under 35 U.S.C. §371 of International Application No. PCT/SE2013/051402 filed Nov. 27, 2013, published in English, which claims priority from Swedish Application No. 1251345-3 filed Nov. 28, 2012, all of which are hereby incorporated herein by reference. The invention relates to a screening apparatus according to the preamble of claim 1, to a rotor and wing package for said screening apparatus and to a method for manufacture of said screening apparatus.

FIELD OF THE INVENTION

The present invention relates to a screening apparatus. More particularly, the present invention relates to a rotor and wing package for said screening apparatus and to a method for manufacture of said screening apparatus.

BACKGROUND OF THE INVENTION

Screening in papermaking means separation of foreign or different particles from a pulp suspension and may be done in different process steps in a fiber line.

Pulp from cooking inevitably contains unwanted solid material. Some of the chips may not have cooked properly, and some of the fibrous material may not be completely in the form of individual fibers. Defects in wood may show up as non-fibrous solids. Contaminants other than wood may also enter cooking with chips. The purpose of screening is to remove these impurities from the main pulp stream for reject treatment as efficiently as possible and wash off the good fibers, return these to the main pulp stream and prepare the reject for treatment.

A screening apparatus, see e.g. EP0 444 051, may comprise a screen housing enclosing a cylindrical barrier, called a screen member, having apertures in the form of e.g. holes or slits for the actual screening. The screening apparatus may further comprise an inlet for the pulp suspension leading into the screen member, an accept outlet for accept, i.e. material with small particles that has passed through the screen member from the inside and out, and a reject outlet for reject, i.e. material with large particles which has not passed the screen member.

To improve the screening, the screening apparatus may e.g. be provided with some sort of rotor having pulsations members, e.g. blades or protrusions. Said rotor rotates inside the screen member or else the screen member may be rotating. Further, the screen member may be provided with different variants of protrusions on its inner surface.

In the prior art section of EP 205 623 there is shown an open solution with wings attached to a "spider" and a reinforcement ring. The loose structure is very unstable and not sufficiently rigid to withstand the forces especially since the wings are attached with screws or bolts. A similar loose, unstable structure is shown in U.S. Pat. No. 4,328,096.

In EP 444 051 and EP 868 564 the rotor is designed as a cylindrical rotor body having arms with pulsation generating members, also called blades or wings, which are attached on the mantle area of the rotor body. They have complicated manufacture, since a complicated fixture is needed in order to position the wings radially and circumferentially. Several complicated fixtures are needed to be able to handle different screening apparatus sizes as well.

It is also complicated to change the wings, when they are worn or if you want to change the wing design e.g. in order to optimize the energy consumption. In order to get sufficient precision, the wings are preferably cast, which may cause strength problems. Further, cast wings may be warped and have to be aligned. Cracks may occur in cast wings.

SUMMARY OF THE INVENTION

In accordance with the present invention, these and other problems have now been solved by the invention of a screening apparatus for screening a pulp suspension comprising a casing, a screening member disposed within the casing, a rotor disposed for rotation relative to the screening member, whereby a screening chamber is formed between the rotor and the screening member, a pulp inlet for providing the pulp to the rotor, an accept outlet for accepting pulp passing through the screening member, and a reject outlet for rejected pulp not passing through the screening member, the rotor including a rotor body and detachable pulsation package comprising at least one attachment ring attached to the rotor body, at least one support ring attached to or supported by the rotor body, and at least one pulsation member attached to the at least one attachment ring and at the least one support ring. Preferably, the screening member is cylindrical In one embodiment, the rotor body includes a pair of end surfaces and the attachment ring is attached to one of the end surfaces of the rotor body. Preferably, at least one attachment ring has a circular profile including an inner portion and an outer portion, and the inner portion of the at least one attachment ring is attached to the rotor body.

In accordance with another embodiment of the screening apparatus of the present invention, the at least one pulsation member includes a first end and a second end, wherein the first end of the at least one pulsation member is attached to the at least one attachment ring and the second end of the at least one pulsation member is attached to the at least one support ring. Preferably, one of the first and second ends of the at least one pulsation member extends a distance of at less than about 200 mm outside of the attachment of the at least one pulsation member to the at least one attachment ring or the at least one support ring.

In accordance with another embodiment of the screening apparatus of the present invention, the apparatus includes at least two pulsation members, and the at least one attachment ring includes an outer periphery including cut-out portions between the attachments of the at least two pulsation members to the at least one attachment ring, in order to improve the pulp flow therein.

In one embodiment, the at least one support ring includes an outer periphery including cut-out portions between the attachment of the at least two pulsation members to the at least one support ring, in order to improve the pulp flow therein. In one embodiment, the pulsation member comprises a bent plate. In another embodiment, the pulsation member comprises a cast profile.

In accordance with another embodiment of the screening apparatus of the present invention, the apparatus includes a dilution water outlet proximate to the rotor body, the rotor body also including a wear ring proximate to the dilution water outlet.

In accordance with the present invention, a rotor has also been invented for use in a screening apparatus for screening pulp suspensions, the screening apparatus comprising a casing, a screening member disposed within the casing, a rotor disposed for rotation relative to the screening member, whereby a screening chamber is formed between the rotor and the screening member, a pulp inlet for providing the pulp to the rotor, an accept outlet for accepting pulp passing through the screening member, and a reject outlet for rejected pulp not passing through the screening member, the rotor including a detachable pulsation package containing at least one attachment ring attached to the rotor body, at least one support ring attached to or supported by the rotor body, and at least one pulsation member attached to the at least one attachment ring and the at least one support ring. In a preferred embodiment, the rotor body includes a pair of end surfaces and the attachment ring is attached to one of the end surfaces of the rotor body.

In accordance with the present invention, a pulsation member package has also been invented for a screening apparatus for screening pulp suspensions, the screening apparatus comprising a casing, a screening member disposed within the casing, a rotor disposed for rotation relative to the screening member, wherein a screening chamber is formed between the rotor and the screening member, a pulp inlet for providing the pulp to the rotor, an accept outlet for accepting the pulp passing through the screening member, a reject outlet for rejected pulp not passing through the screening member, and a detachable pulsation member package arranged for attachment to the rotor body, the detachable pulsation member package comprising at least one attachment ring attached to the rotor body, at least one support ring attached to or supported by the rotor body, and at least one pulsation member attached to the at least one attachment ring and the at least one support ring. In a preferred embodiment, the rotor body includes an end surface, and the attachment ring is arranged to be attached to the end surface of the rotor body.

In accordance with the present invention, a method has also been devised for the manufacture of a rotor for screening apparatus comprising providing at least one attachment ring, at least one support ring, and at least one pulsation member; providing a rotor body having an end surface; aligning at least one attachment ring and the at least one support ring along the rotor body; attaching the at least one pulsation member to the at least one attachment ring and to the at least one support ring; and attaching the at least one attachment ring to the rotor body and attaching or supporting at least one support ring to the rotor body. In a preferred embodiment the method includes attaching the at least one pulsation member to the at least one attachment ring and the at least one support ring on the end surface of the rotor body.

In accordance with the present invention, a method has also been devised for the manufacture of a pulsation member package for screening apparatus comprising providing at least one attachment ring, at least one support ring and at least one pulsation member, whereby the at least one attachment ring is arranged to be attached to a rotor body; providing a fixture; aligning at least one attachment ring and the at least one support ring along the fixture; and attaching the at least one pulsation member to the at least one attachment ring and at least one support ring to the fixture.

One advantage of the present invention is that manufacture is made simpler. Further, when the pulsation members become worn, the pulsation member package is easily replaced as a spare part, without any need for replacing the whole rotor. Thus, the rotor body may be reused.

Another advantage of the present invention is higher flexibility. One possibility is to have the rotor body as a standardized part, which is the same for all or many different types of screening apparatuses. The rotor body is then only used with the pulsation member package that is appropriate for the screening apparatus in question. This makes manufacture cheaper and simpler.

Further, for example, if one wishes to test different pulsation member configurations for optimization of e.g. energy consumption, production or screening result, the pulsation member package may be easily exchanged and tested also by the customer himself.

BRIEF DESCRIPTION OF THE DRAWINGS

The present invention, together with further objects and advantages thereof, may best be understood by reference to the following member description and appended drawings, in which.

DETAILED DESCRIPTION

Figure 1A:
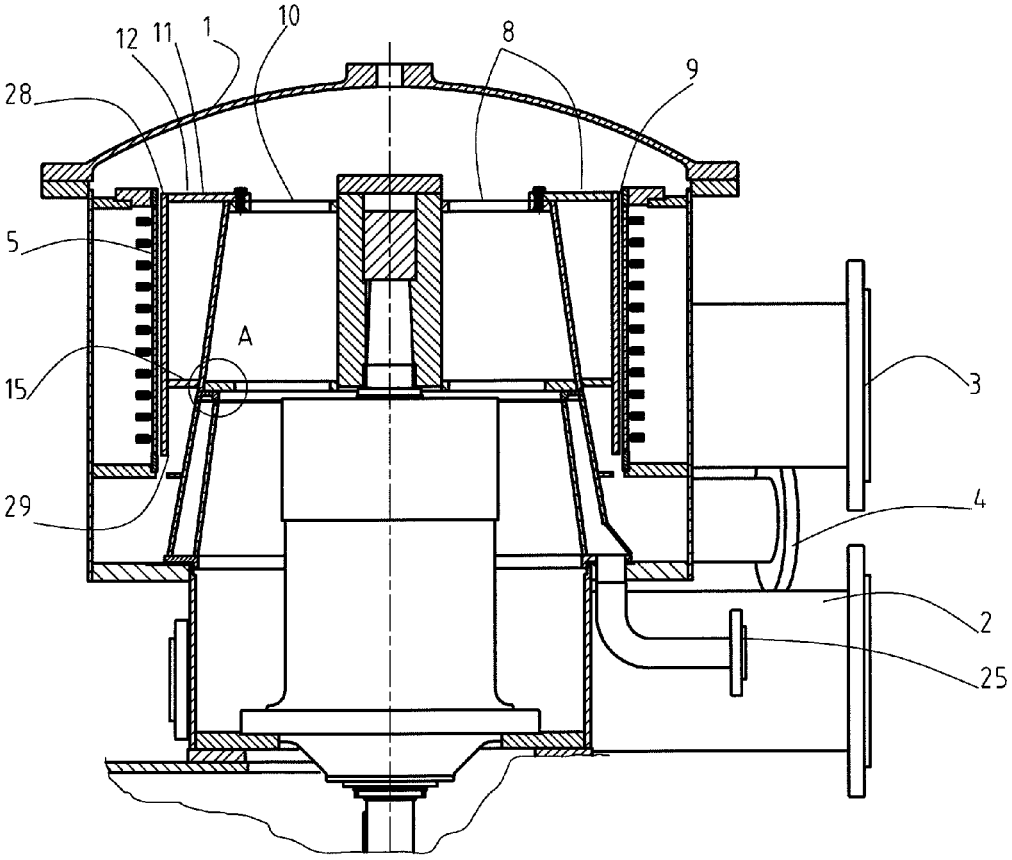
FIG. 1*a* is a side elevational partially cross-sectional view of a screening apparatus according to one embodiment of the present invention.

In the drawings, similar or corresponding elements are denoted by the same reference numbers.

Figure 1B:
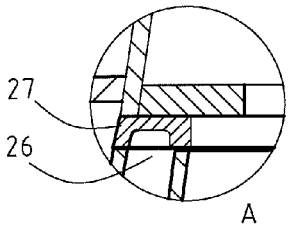
FIG. 1*b* is a partial side sectional view of the portion A of the screening apparatus shown in Figure al.

In FIG. 1*a-b* is shown a screening apparatus. In this example the screening apparatus is a single screening apparatus, but the invention may of course be used in any screening apparatus—coarse or fine—having one or more screening members.

The screening apparatus in FIG. 1*a-b* comprises an airtight casing 1 with an inlet 2 for pulp suspension, an accept outlet 3, a reject outlet 4 and a dilution water inlet 25. In the casing 1 a cylindrical screening member 5 is arranged, preferably with the axis of symmetry being vertical.

Within the screening member 5 a rotor 8 is located, which rotor 8 comprises a cylindrical or conical rotor body 10 and a detachable pulsation member package 11. The rotor 8 is concentric with the screening member 5, so that a screening chamber 9 is formed between the rotor 8 and the screening member 5. A not shown motor drives the rotor 8.

It is to be understood that the rotor embodiments described in the following description is not restricted to the screening apparatus shown in FIG. 1*a-b*, but may be used in any kind of screening apparatus for coarse or fine screening, for screening from inside and out or for screening outside and in, etc.

Figure 2A:
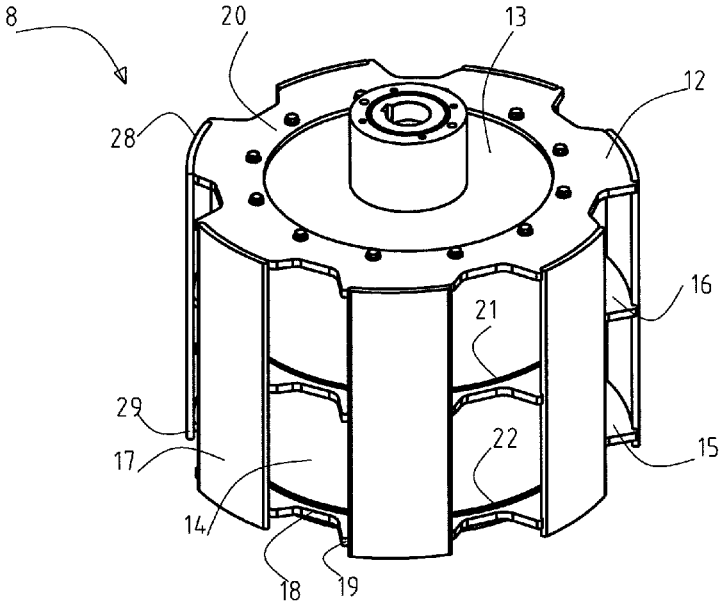
FIG. 2*a* is a side elevational view of a rotor with a pulsation member package according to another embodiment of the present invention.
Figure 2B:
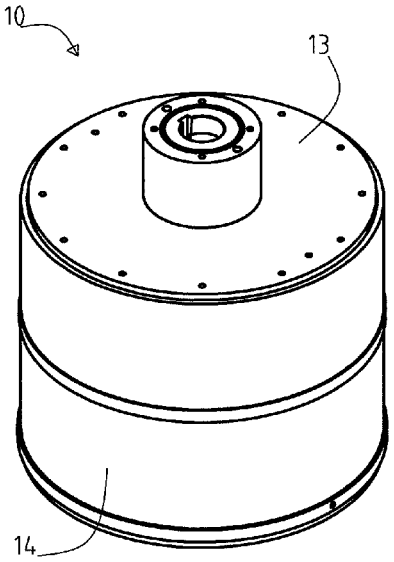
FIG. 2*b* is a side, elevational view of a rotor in accordance with the embodiment of the present invention shown in FIG. 2*a;*
Figure 2C:
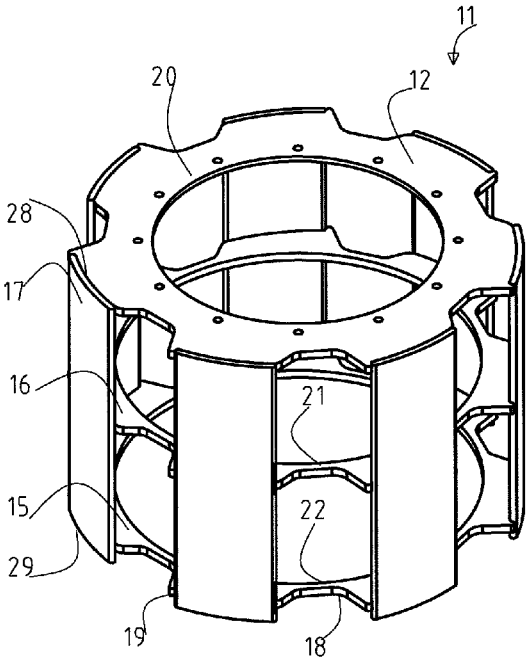
FIG. 2*c* is a side elevational view of a pulsation member package for use in the embodiment of the present invention shown in FIG. 2*a;*
Figure 2D:
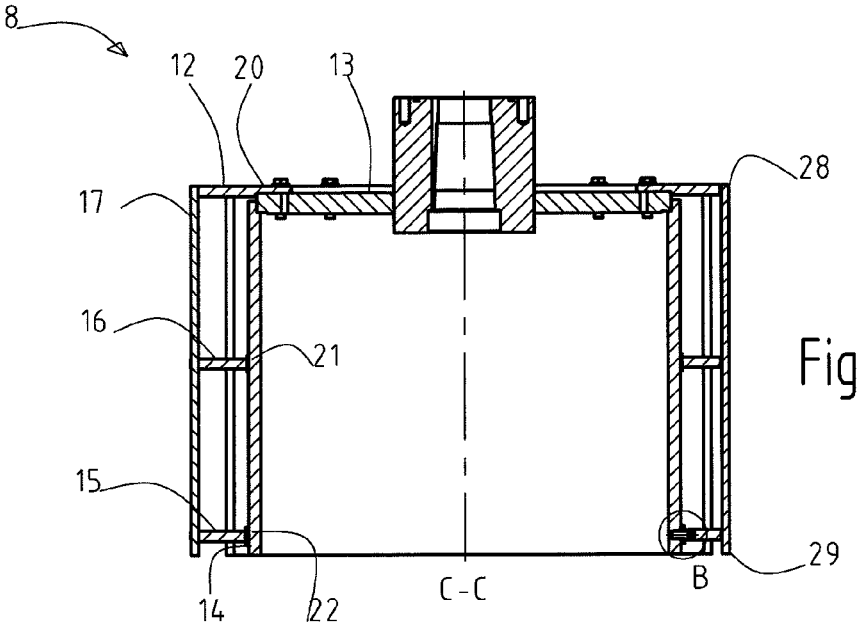
FIG. 2*d* is a side elevational cross-sectional view of the rotor and pulsation member package shown in FIG. 2*a;*
Figure 2E:
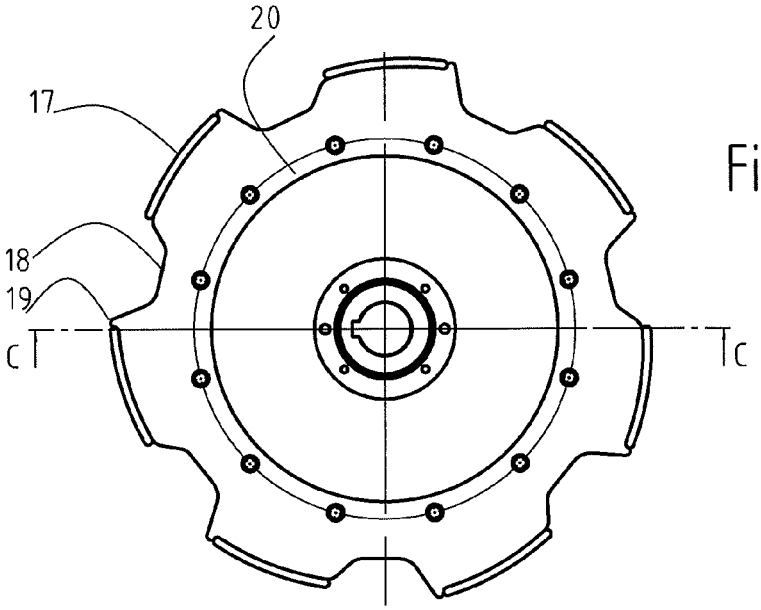
FIG. 2*e* is a top elevational view of the rotor and pulsation member package shown in FIG. 2*a;*
Figure 2F:
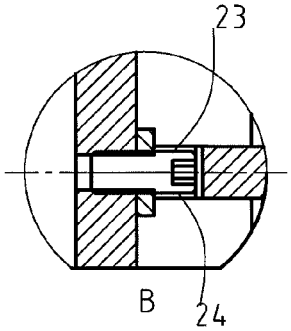
FIG. 2*f* is a partial side cross-sectional view of the portion of the rotor and pulsation package shown in FIG. 2*d* designated by section B.

In FIG. 2*a-f* another embodiment of the rotor 8 is shown in more detail. In FIG. 2*b* the rotor body 10 is shown without the pulsation member package 11. In FIG. 2*c* the pulsation member package 11 is shown without the rotor body 10.

The rotor body 10 preferably has a cylindrical, conical or similar stable shape. The pulsation member package in FIG. 2*a-c* comprises an attachment ring 12, a first support ring 15, a second support ring 16 and seven pulsation generating members 17, such as wings. The attachment ring 12 in FIG. 2*a-c* is preferably located in one end of the pulsation member package 11, while the first support ring 15 is located in the other end of the pulsation member package 11 and the second support ring 16 is located in between the attachment ring 12 and the first support ring 15. The pulsation members 17 are attached to the attachment ring 12, the first support ring 15 and the second support ring 16.

The attachment ring 12 is preferably attached to an end surface 13 of the rotor body 10. It is of course possible to instead attach the attachment ring 12 on a mantle surface 14 of the rotor body 10 and then e.g. have the attachment ring 12 between the first support ring 15 and the second support ring 16. However, an attachment on the end surface 13 will be more stable and less influenced by the passing pulp. The attachment is especially stable if the attachment is made all around the attachment ring 12, especially if the inner part 20 of the attachment ring 12 is provided with a circular profile, and said inner part 20 is attached to the rotor body 10.

Since the pulsation member package 11 is meant as a wear part, the attachment is preferably made by screws or bolts, but welding is of course also possible. The skilled person realises that, if welding is used, the number of welding points and the weld size should be such that the weld can easily be cut off without destroying the pulsation member package 11. Weld joints of a limited size can be used either as sole joints or together with screws or bolts.

It is possible to have more than one attachment ring 12.

The first support ring 15 and the second support ring 16 have inner diameters 22, 21 that are adapted so that the support rings 15, 16 will be supported by the rotor body 10. In small configurations it might be sufficient with only one support ring 15 and in large configurations more support rings might be needed for improved stability.

It is not necessary to attach the support rings 15, 16 to the rotor body 10, as long as the support rings 15, 16 are supported by the rotor body 10. It is of course possible to attach also the support rings 15, 16 to the rotor body 10, but that gives a higher fit requirement and thus a higher manufacture cost. A solution with less fit requirements might be just a pin 23 attached to the rotor body 10 and a notch 24 in the support ring 15, 16 or vice versa, see FIG. 2*f*.

To improve the pulp flow through the screening apparatus and around the pulsation members 17, the attachment ring 12 and the support rings 15, 16 may be provided with cut-outs 18 in their outer peripheries 19.

The pulsation members 17 are preferably attached with one end 28, 29 to one attachment ring 12 or support ring 15 and with another end 28, 29 to another attachment ring 12 or support ring 15, because that makes the most stable configuration. It is, however, possible to have pulsation members 17 having a free end 28, 29 that extend a bit outside the attachment ring 12 or support ring 15 as in FIG. 1*a*. Said extension is, however, preferably not longer than 200 mm, for stability. The pulsation members 17 are preferably attached by welding, but may also be e.g. screwed or bolted.

FIG. 2*a-c* shows an embodiment with seven pulsation members 17, but any number is possible. For stability, the pulsation members 17 are preferably evenly arranged around the rings 12, 15, 16. The pulsation members 17 are simplest and cheapest made of bent plate. An alternative is to cast the pulsation members 17 in a more profiled shape. An advantage with a cast pulsation member 17 is that any shape can be achieved, e.g. like an aeroplane wing.

FIG. 2*a-c* shows straight pulsation members 17 that are parallel to an axis of the rotor body 10 in two dimensions. It is, however, possible also to have pulsation members 17 that are e.g. inclined in one dimension.

Preferably, the distance between two pulsation members 17 is the same as the width of a pulsation member 17. The thickness of the pulsation members 17 may be e.g. 10-12 mm.

When the pulsation members 17 are worn, the pulsation member package 11 is easily replaced as a spare part, without any need for replacing the whole rotor 8. Thus, the rotor body 10 may be reused.

A possibility is also to have the rotor body 10 as a standardized part, which is the same for all or many different types of screening apparatuses. The rotor body 10 is then just used with the pulsation member package 11 that is appropriate for the screening apparatus in question. This makes manufacture cheaper and simpler.

Further, if there e.g. is a wish to test different pulsation member configurations for optimization of e.g. energy consumption, production or screening result, the pulsation member package 11 may be easily exchanged and tested also by the customer himself.

Figure 3A:
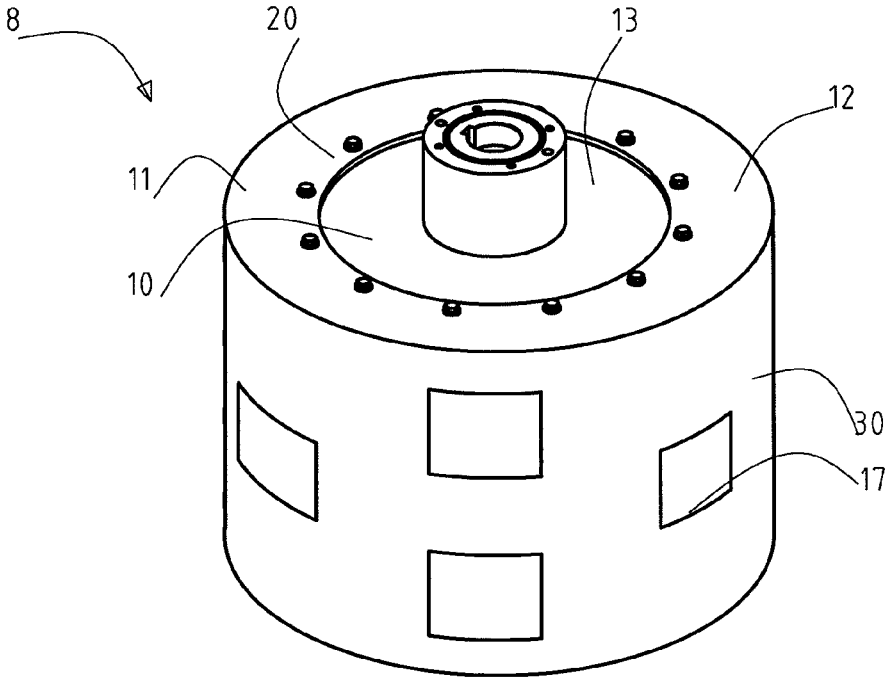
FIG. 3*a* is a top side elevational view of a rotor with a pulsation member package in accordance with another embodiment of the present invention.
Figure 3B:
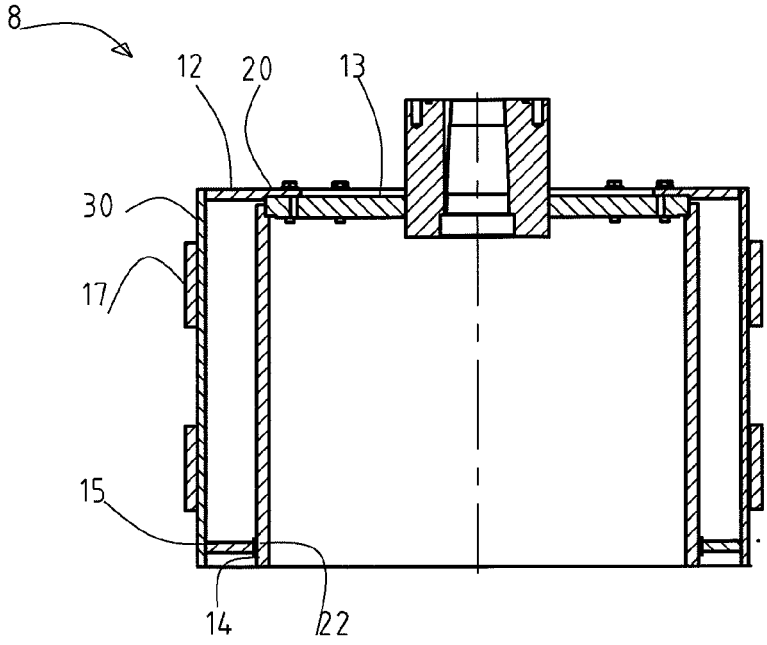
FIG. 3*b* is a side cross-sectional view of the rotor with pulsation member package shown in FIG. 3*a*.

In FIG. 3 is shown an embodiment where the pulsation member package 11 is a cylinder 30 with an attachment ring 12 and a support ring 15 and a number of pulsation members 17. In this embodiment the pulsation members are attached to the cylinder 30, which cylinder 30 is attached to the attachment ring 12 and support ring 15. This means that the pulsations members 17 are indirectly attached to the attachment ring 12 and the support ring 15, unlike the other embodiments where the pulsation members are directly attached to the attachment ring 12 and the support ring 15.

The screening apparatus may be provided with an inlet 25 for dilution water, see FIG. 1*a-b*. If there in the other end is an outlet 26 for dilution water arranged at the rotor body 10, then there is a risk that the rotor body 10 will wear. If e.g. the dilution water is not high enough and fibers stick at the outlet 26, torsion and thus wear may occur. In order to keep the rotor body 10 as a part that will not wear unnecessarily, the rotor 8 may therefore be provided also with a wear ring 27 in the proximity of the dilution water outlet 26. In this embodiment the wear ring 27 is attached on the bottom of the rotor body 10. This means that the rotor 8 in FIG. 1 is provided with two wear parts: a pulsation member package 11 and a wear ring 27. The wear ring 27 may of course also be used separately as spare part.

When the rotor 8 is manufactured there is no need for any complicated fixtures. Either the pulsation member package 11 is applied directly on the rotor body 10 or, if the pulsation member package 11 is made as a spare part, the pulsation member package 11 is applied onto a simple fixture having the contours of a rotor body 10.

Figure 4:
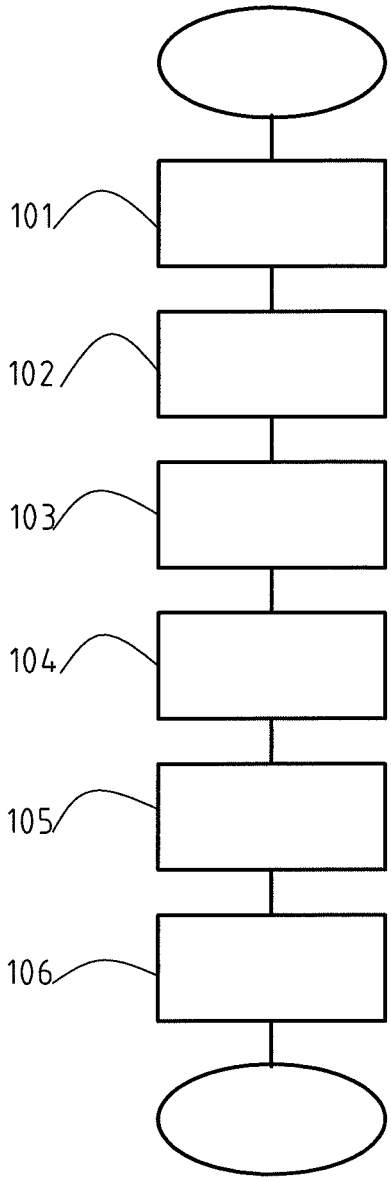
FIG. 4 is a schematic flow chart illustrating a manufacturing process according to the present invention.

First the rotor body 10 or simple fixture is made, if necessary, step 101, FIG. 4. See also any of the FIGS. 1*a-b*, 2*a-f*, and 3*a-b*.

The attachment and support rings 12, 15, 16 are each precision cut, e.g. water cut, by cutting the contours and positions for the pulsation members 17 and the contours and positions for the cut-outs 18, if any, between the pulsation members 17, step 102. If the cut is made with sufficient precision the attachment and support rings 12, 15, 16 may later serve as a fixture for the pulsation members 17.

The pulsation members 17 are made by e.g. cutting and bending the pulsation members 17 from a plate or by e.g. casting the pulsation members 17 to an appropriate shape, step 103.

The rotor body 10 or the simple fixture is positioned, preferably vertically, step 104.

At least one attachment ring 12 and at least one support ring 15, 16 are aligned along the rotor body 10 or simple fixture and are attached or supported, step 105. Supports attached to the rotor body 10 or simple fixture is preferably used for the vertical alignment.

At least one pulsation member 17 is attached to the at least one attachment ring 12 and the at least one support ring 15, 16, step 106. This will also enable the rotary alignment of the at least one attachment ring 12 and the at least one support ring 15, 16.

The invention is of course not restricted to the shown embodiments, but may be varied within the scope of the claims.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A screening apparatus for screening a pulp suspension comprising a casing, a screening member disposed within said casing, a rotor disposed for rotation relative to said screening member, whereby a screening chamber is formed between said rotor and said screening member, a pulp inlet for providing said pulp to said rotor, an accept outlet for accepting pump passing through said screening member, and a reject outlet for rejected pulp not passing through said screening member, said rotor including a rotor body and a detachable pulsation package comprising at least one attachment ring attached to said rotor body, at least one support ring attached to or supported by said rotor body, and at least one pulsation member attached to said at least one attachment ring and said at least one support ring.

2. The screening apparatus of claim 1, wherein said screening member is cylindrical.

3. The screening apparatus of claim 1, wherein said rotor body includes a pair of end surfaces and said attachment ring is attached to one of said end surfaces of said rotor body.

4. The screening apparatus of claim 3, wherein said at least one attachment ring has a circular profile including an inner portion and an outer portion, and wherein said inner portion of said at least one attachment ring is attached to said rotor body.

5. The screening apparatus of claim 1, wherein said at least one pulsation member includes a first end and a second end, wherein said first end of said at least one pulsation member is attached to said at least one attachment ring and said second end of said at least one pulsation member is attached to said at least one support ring.

6. The screening apparatus of claim 5, wherein one of said first and second ends of said at least one pulsation member extends a distance of less than about 200 mm outside of said attachment of said at lease on pulsation member to said at least one attachment ring or said at least one support ring.

7. The screening apparatus of claim 1, including at least two pulsation members, and wherein said at least one attachment ring includes an outer periphery including cut-out portions between the attachments of said at least two pulsation members to said at least one attachment ring, in order to improve the pulp flow therein.

8. The screening apparatus of claim 1, wherein said at least one support ring includes an outer periphery including cut-out portions between the attachment of said at least two pulsation members to said at least one support ring, in order to improve the pulp flow therein.

9. The screening apparatus of claim 1 wherein said at least one pulsation member comprises a bent plate.

10. The screening apparatus of claim 1, wherein said at least one pulsation member comprises a cast profile.

11. The screening apparatus of claim 1, including a dilution water outlet proximate to said rotor body, said rotor body also including a wear ring proximate to said dilution water outlet.

12. A rotor for use in a screening apparatus for screening pulp suspensions, said screening apparatus comprising a casing, a screening member disposed within said casing, a rotor disposed for rotation relative to said screening member, whereby a screening chamber is formed between said rotor and said screening member, a pulp inlet for providing said pulp to said rotor, an accept outlet for accepting pulp passing through said screening member, and a reject outlet for rejected pulp not passing through said screening member, said rotor including a detachable pulsation package containing at least one attachment ring attached to said rotor body, at least one support ring attached to or supported by said rotor body, and at least one pulsation member attached to said at least one attachment ring and said at least one support ring.

13. A rotor according to claim 12, wherein said rotor body includes a pair of end surfaces and said at least one attachment ring is attached to one of said end surfaces of said rotor body.

14. A pulsation member package for a screening apparatus for screening pulp suspensions, said screening apparatus comprising a casing, a screening member disposed within said casing, a rotor disposed for rotation relative to said screening member, whereby a screening chamber is formed between said rotor and said screening member, a pulp inlet for providing said pulp to said rotor, an accept outlet for accepting pulp passing through said screening member, a reject outlet for rejected pulp not passing through said screening member, and a detachable pulsation member package arranged for attachment to said rotor body, said detachable pulsation member package comprising at least one attachment ring attached to said rotor body, at least one support ring attached to or supported by said rotor body, and at least one pulsation member attached to said at least one attachment ring and said at least one support ring.

15. The pulsation member package of claim 14, wherein said rotor body includes an end surface, and said at least one attachment ring is arranged to be attached to said end surface of said rotor body.

16. A method for the manufacture of a rotor for screening apparatus comprising providing at least one attachment ring, at least one support ring, and at least one pulsation member; providing a rotor body having an end surface; aligning said at least one attachment ring and said at least one support ring along said rotor body; attaching said at least one pulsation member to said at least one attachment ring and to said at least one support ring; and attaching said at least one attachment ring to said rotor body and attaching or supporting said at least one support ring to said rotor body.

17. The method of claim 16 including attaching said at least one pulsation member to said t least one attachment ring and said at least one support ring on said end surface of said rotor body.

18. A method for the manufacture of a pulsation member package for screening apparatus comprising providing at least one attachment ring, at least one support ring, and at least one pulsation member, whereby said at least one attachment ring is arranged to be attached to a rotor body; providing a fixture; aligning said at least one attachment ring and said at least one support ring along said fixture; and attaching said at least one pulsation member to said at least one attachment ring and said at least one support ring to said fixture.

* * * * *